United States Patent [19]

Morse

[11] Patent Number: 4,827,725

[45] Date of Patent: May 9, 1989

[54] SUCTION ACCUMULATOR WITH DIRT TRAP

[75] Inventor: Robert L. Morse, Adrian, Mich.

[73] Assignee: Tecumseh Products Company, Tecumseh, Mich.

[21] Appl. No.: 215,073

[22] Filed: Jul. 5, 1988

[51] Int. Cl.[4] ..... F25B 43/00

[52] U.S. Cl. ..... 62/503; 55/192

[58] Field of Search ..... 62/503; 55/192

[56] References Cited

U.S. PATENT DOCUMENTS

| | | | |
|---|---|---|---|
| 3,020,729 | 2/1962 | Brandin | 62/503 |
| 3,540,230 | 11/1970 | Evans | 62/471 |
| 4,111,005 | 9/1978 | Livesay | 62/503 |
| 4,270,934 | 6/1981 | Widdowson et al. | 55/316 |
| 4,276,756 | 7/1981 | Livesay | 62/503 |
| 4,354,362 | 10/1982 | Schumacher et al. | 62/474 |
| 4,474,035 | 10/1984 | Amin et al. | 62/503 |
| 4,509,340 | 4/1985 | Mullally et al. | 62/503 |
| 4,528,826 | 7/1985 | Avery, Jr. | 62/503 |
| 4,583,377 | 4/1986 | Viegas | 62/503 |
| 4,627,247 | 12/1986 | Morse | 62/503 |
| 4,633,679 | 1/1987 | Wintersteen | 62/474 |
| 4,651,540 | 3/1987 | Morse | 62/503 |

*Primary Examiner*—Ronald C. Capossela
*Attorney, Agent, or Firm*—Albert L. Jeffers; John F. Hoffman; David L. Ahlersmeyer

[57] ABSTRACT

A suction accumulator for the compressor of a refrigeration system is disclosed in which a vertical fluid storage vessel comprises a cylindrical central member and a lower end cap. A disk-shaped dirt trap baffle member includes at its outer periphery a plurality of circumferentially spaced tabs that are clamped between the central housing member and lower end cap. Circumferentially intermediate the tabs are gaps through which liquid refrigerant flows from an active zone above the baffle to a quiet zone therebelow. Within the quiet zone, liquid refrigerant flows from a radially outer region to a radially inner region along a tortuous flow path created by a vertically extending wall comprising a portion of the baffle member. A bleed-through orifice in a gaseous refrigerant flow conduit siphons liquid refrigerant from the radially inner region into the gaseous flow path. Foreign particles suspended in the liquid refrigerant are isolated within the accumulator at various points along the flow path, particularly within the quiet zone.

30 Claims, 2 Drawing Sheets

SUCTION ACCUMULATOR WITH DIRT TRAP

BACKGROUND OF THE INVENTION

The present invention relates to a refrigerant storage vessel located in-line between the evaporator and the compressor in a typical refrigeration system. More particularly, the invention relates to a suction accumulator which separates the liquid components of the refrigerant from the gaseous components thereof and provides a storage or sump for the liquid refrigerant.

Most compressors adapted for use in refrigeration systems are designed for the compression of gaseous refrigerant. However, under some circumstances liquid refrigerant may flow from the evaporator into the suction inlet of the compressor. This condition, often referred to as slugging, may occur at start-up of the refrigeration system or during certain operating conditions of the system wherein the evaporator is flooded and excess liquid refrigerant enters the suction line returning to the compressor. If an accumulator is not provided, large quantities of condensed refrigerant return through the suction line to the crankcase of the compressor. When the compressor is restarted, the large quantity of liquid refrigerant present therein results in abnormally high pressures which frequently cause blown gaskets, broken valves, etc.

Suction accumulators, which are well known in the art, have been incorporated into refrigeration systems to act as storage reservoirs for liquid refrigerant which may be present in the suction line to prevent such liquid refrigerant from entering the compressor. Such accumulators permit the liquid refrigerant to change to its gaseous state before entering the compressor. A common type of accumulator comprises a vessel having a generally U-shaped tube received therein, one end of which is connected to the storage vessel and the other end of which is open to the interior of the vessel. As the incoming refrigerant flows into the vessel, the liquid component collects in the bottom thereof while the gaseous component is carried off through the U-tube and the outlet of the vessel to the compressor suction inlet. A bleed-through orifice in the wall of the U-tube, located in the lower portion of the vessel, meters a small quantity of liquid refrigerant into the stream of gaseous refrigerant flowing through the tube so that a larger slug of refrigerant is not introduced into the inlet of the compressor on start-up or during operation thereof. Such accumulators may furthermore provide for pressure equalization, whereby the pressure at the outlet of the suction accumulator is equalized with the pressure in the liquid storage vessel. This prevents higher pressures in the liquid from forcing liquid refrigerant into the suction inlet of the compressor when the compressor is turned off.

A problem associated with a refrigeration system of the type to which the present invention pertains, includes the presence of dirt particles, and the like, suspended in the refrigerant and entrained lubricating oil. When carried through the refrigeration system with the refrigerant, such dirt particles can cause premature mechanical wear or failure of system components, or impede the flow of refrigerant through the system, thereby causing system operating inefficiencies.

Various methods have been proposed for filtering dirt particles suspended in the refrigerant and lubricating oil of a refrigeration system, several of which are associated with the suction accumulator of the refrigeration system. For instance, it is known to provide a screen filter at the entry of the suction accumulator, whereby a screen essentially partitions the storage vessel between an entry chamber and a storage chamber. One problem with such an arrangement is that the filter screen is disposed within the refrigerant flow path, thereby causing an undesirable pressure drop in the refrigeration system. Furthermore, accumulation of the dirt particles on the filter screen could eventually cause clogging of the screen and a further pressure drop in the system.

Another approach to filtering dirt particles from a refrigeration system, involving the suction accumulator, is the provision of a filter at the location of the bleed through orifice located in the lower portion of the accumulator storage vessel. In such an accumulator, dirt particles are carried with the refrigerant into the vessel and are prevented from entering the bleed through orifice by means of a filter. However, the swirling, turbulent environment within the storage vessel can result in the dirt particles reentering the refrigeration system through the open end of the U-tube. Furthermore, the provided filter can become clogged, thereby interfering with the desired metering of the liquid refrigerant into the gaseous refrigerant flow path.

While prior art attempts to filter dirt particles from the refrigerant in a refrigeration system have been somewhat successful, it is desired to provide an improved suction accumulator that is capable of trapping and isolating dirt particles, and preventing their reintroduction into the refrigeration system.

SUMMARY OF THE INVENTION

The present invention overcomes the disadvantages of the above-described prior art suction accumulators by providing an improved suction accumulator for a refrigeration system wherein foreign particles suspended in the refrigerant of a refrigeration system are separated and isolated in the accumulator, thereby preventing reentry of the particles into the refrigeration system and possible damage caused thereby.

In general, the invention provides a suction accumulator comprising a storage vessel for storing liquid and gaseous refrigerant introduced through a vessel inlet and drawn out through a vessel outlet. A conduit within the vessel has one end connected to the vessel outlet and the other end open to the vessel interior to provide a flow path for gaseous refrigerant to exit the vessel. Liquid from the bottom of the storage vessel is metered into the conduit so as to enter the gaseous refrigerant flow path. In one aspect of the invention, liquid refrigerant entering the vessel is directed to a radially outer region at the bottom of the vessel, and then flows radially inwardly along a tortuous path before being metered into the conduit.

In another aspect of the invention, the storage vessel interior is separated between an upper active zone and a lower quiet zone. Liquid refrigerant is introduced into the lower quiet zone and then metered into the conduit. Foreign particles suspended in the refrigerant are separated from the refrigerant and isolated within the lower quiet zone. The lower quiet zone may be provided with two regions successively interconnected along a tortuous flow path, whereby foreign particles become isolated in both regions. Also, foreign particles may be isolated in the active zone and prevented from entering the quiet zone.

More specifically, the invention provides, in one form thereof, a suction accumulator wherein a vertical storage vessel includes an inlet, an outlet, and a conduit within the vessel providing fluid communication between the interior of the vessel and the vessel outlet. The conduit extends toward the bottom of the vessel whereat liquid refrigerant is metered into a gaseous refrigerant flow passageway in the conduit. A baffle member separates the vessel into an upper active zone and a lower quiet zone. Liquid refrigerant flows from the active zone, around the outer peripheral edge of the baffle member, to a radially outer region of the quiet zone. An upwardly extending barrier is provided between the radially outer region and a radially inner region of the quiet zone, around which refrigerant must flow so as to provide a tortuous flow path. Liquid refrigerant is metered from the radially inner region into the conduit.

One advantage of the suction accumulator of the present invention is that foreign particles suspended in the refrigerant fluid of a refrigeration system may be isolated within a quiet zone of the suction accumulator, thereby preventing reentry of the particles into the refrigeration system and possible damage caused thereby.

Another advantage of the suction accumulator of the present invention is that isolation of foreign particles within the refrigerant fluid is accomplished without the associated system pressure drops commonly experienced in prior art filtering methods.

A further advantage of the suction accumulator of the present invention is that the accumulation, over time, of foreign particles in the suction accumulator will not degrade refrigeration system performance or prevent the suction accumulator from continuing to isolate further foreign particles.

Yet another advantage of the suction accumulator of the present invention is the provision of a simple, inexpensive method of isolating foreign particles from the refrigerant fluid of a refrigeration system.

A still further advantage of the suction accumulator of the present invention is that foreign particles of different sizes are capable of being isolated at different points along the flow path of the liquid refrigerant, as the refrigerant flows from within the storage vessel to the metering opening of the conduit whereat entry into the gaseous refrigerant passageway occurs.

The present invention, in one form thereof, comprises a suction accumulator including a vertical storage vessel defining an interior storage volume. The vessel has a top end and a bottom end and includes a vessel inlet and a vessel outlet located at the top end. The vessel is adapted for storing gaseous and liquid refrigerant introduced through the vessel inlet for drawing out through the vessel outlet. A conduit is disposed within the vessel and has one end connected to the vessel outlet. The conduit includes a gas inlet opening located toward the vessel top end for communication with the gaseous refrigerant. The conduit also has a liquid inlet opening located in a radially inner region of the interior storage volume toward the vessel bottom end for communication with the liquid refrigerant. The suction accumulator also includes a baffle disposed within the vessel for directing the liquid refrigerant within the vessel to a radiantly outer region of the interior storage volume located toward the vessel bottom end. An upwardly extending barrier is disposed between the radially outer region and the radially inner region, and causes tortuous flow of the liquid refrigerant from the radially outer region to the radially inner region.

The present invention, in one form thereof, further provides a suction accumulator including a vertical storage vessel adapted for storing gaseous and liquid refrigerant introduced through a vessel inlet and drawn out through a vessel outlet. A conduit is disposed within the vessel and has an end opening connected to the vessel outlet. The conduit also includes a gas inlet opening located toward the vessel top end for providing communication with the gaseous refrigerant within the vessel. The conduit also includes a liquid inlet opening located toward the vessel bottom end for providing communication with the liquid refrigerant within the vessel. The suction accumulator also includes a partition located near the bottom end of the vessel for substantially separating the storage volume into a lower quiet zone and an upper active zone. The gas inlet opening is in fluid communication with the active zone, while the liquid inlet opening is in fluid communication with the quiet zone. A passage located adjacent the sidewall of the storage vessel provides fluid communication between the active zone and the quiet zone at a location radially outwardly from the liquid inlet opening.

The present invention, in one form thereof, still further provides a method for separating and isolating foreign particles from refrigerant fluid in a suction accumulator. The accumulator includes a vertical storage vessel defining an interior storage volume and having a top end and a bottom end. The vessel has an inlet and an outlet located at the top end. The steps of the method of the present invention, in accordance with one form thereof, include directing refrigerant fluid through the inlet into the interior storage volume. Next, the refrigerant fluid is separated into a liquid component and a gaseous component. A flow path is provided for the gaseous component to the outlet. Also, a partition is provided within the vessel to define an upper active zone above the partition, and a lower quiet zone below the partition and adjacent the vessel bottom. A further step of the method is to provide a flow path for the liquid component from the active zone to a radially outer region of the quiet zone. Foreign particles are then isolated within the radially outer region. The liquid component within the radially outer region is directed to flow along a tortuous flow path from the radially outer region to a radially inner region of the quiet zone. Foreign particles in the liquid component are then isolated within the radially inner region. Finally, a flow path is provided for the liquid component at the radially inner region to the aforementioned flow path for the gaseous component.

DESCRIPTION OF THE PREFERRED EMBODIMENT

Figure 1:
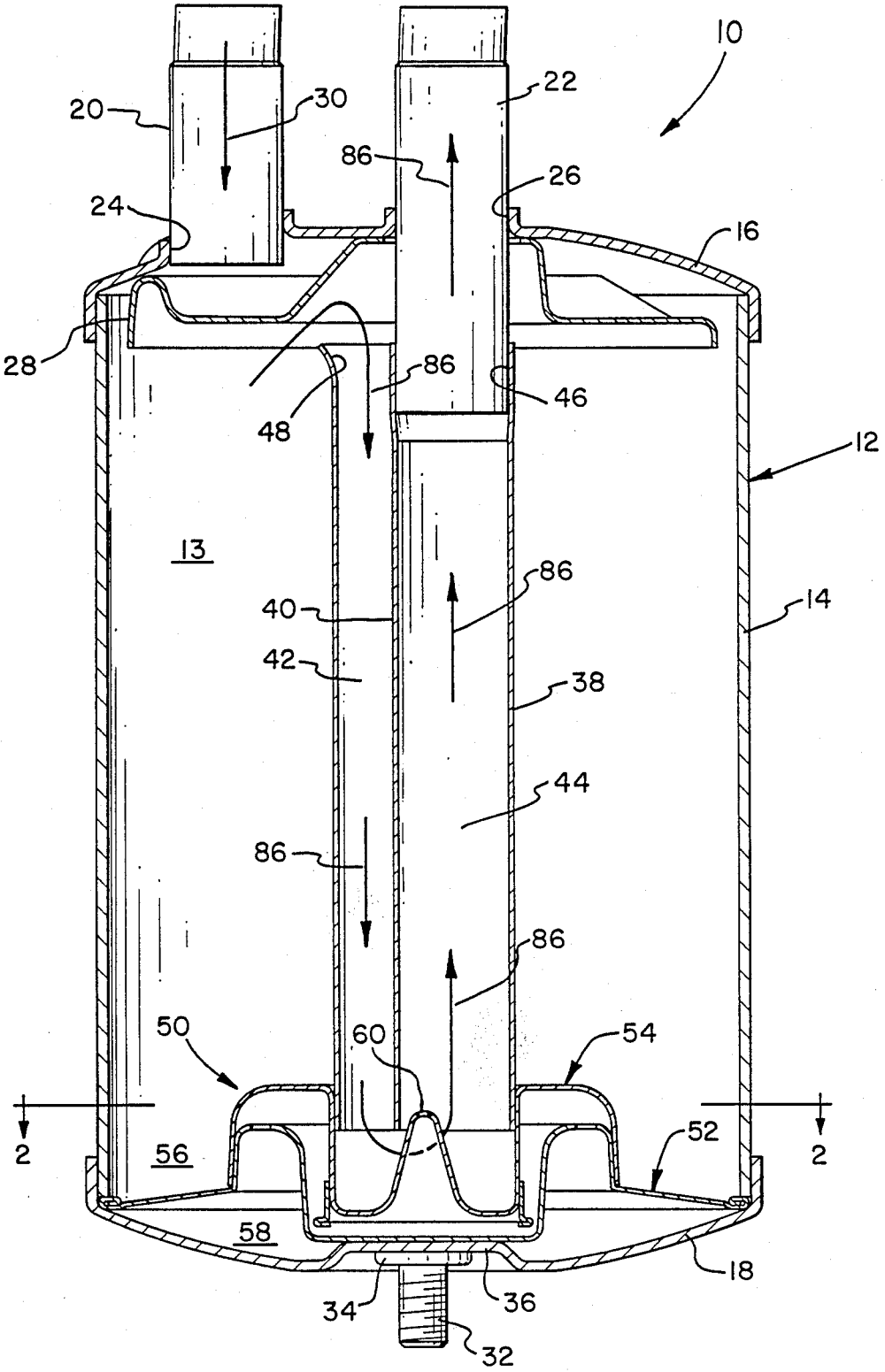
FIG. 1 is an longitudinal sectional view of a suction accumulator in accordance with the present invention.

Referring to FIG. 1, a suction accumulator 10 is shown oriented in its operative, vertical upright position. Accumulator 10 includes a storage vessel 12 comprising a tubular casing 14, a top end wall 16, and a bottom end wall 18. Tubular casing 14 may be either cylindrical, as shown, or some other suitable shape. Vessel 12 defines an interior storage volume 13 adapted for storing gaseous and liquid refrigerant. Suction accumulator 10 also includes an inlet 20 and an outlet 22. Inlet 20 is in communication with an inlet opening 24 in top end wall 16, while outlet 22 is inserted through an outlet opening 26 in top end wall 16. Preferably, the inlet and outlet each comprise copper or aluminum tubes which are sealingly secured to top end wall 16 by soldering, brazing, or the like.

A baffle 28 is shown mounted in an upper portion of vessel 12, whereby refrigerant fluid entering inlet 20, as shown by means of arrow 30 indicating the direction of flow, strikes baffle 28 and is deflected. By means of this arrangement, the refrigerant fluid is separated into a liquid component and a gaseous component, whereby the liquid component is directed to flow in a swirling pattern tangentially along the vessel wall so as to collect in the bottom of vessel 12. The gaseous component flows to outlet 22 by way of a flow path through accumulator 10 as further explained hereinbelow. The construction and method of operation of baffle 28, according to one embodiment thereof, are further described in U.S. Pat. No. 4,651,540, assigned to the same assignee as the present application, the disclosure of which is hereby incorporated herein by reference.

Bottom end wall 18 is provided with a threaded mounting stud 32 to mount the suction accumulator in a vertical position in a refrigeration system, as is conventional. Mounting stud 32 is provided with a welding pad 34 for securing the mounting stud to a depressed portion 36 of end wall 18 that extends inwardly and upwardly into vessel 12.

Figure 3:
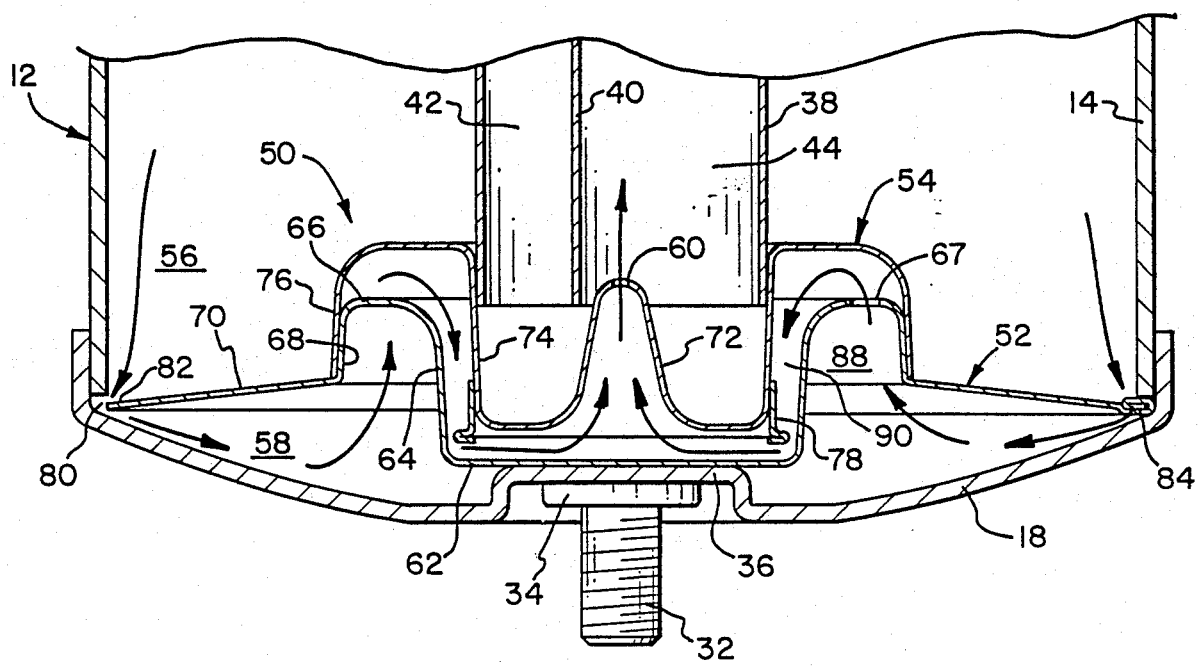
FIG. 3 is an enlarged fragmentary longitudinal sectional view of the suction accumulator of FIG. 1, taken along the line 3—3 in FIG. 2 and viewed in the direction of the arrows.

Referring now to FIGS. 1 and 3, a conduit 38 is shown disposed inside vessel 12. The conduit includes a divider plate or weir 40 to form two fluid flow passages 42 and 44 in conduit 38. Thus, a downflow passage 42 and an upflow passage 44 are provided. Conduit 38 may be made of either extruded plastic material, or of conventional metal tubing materials. As shown in FIG. 1, the top end of conduit 38 includes a first opening 46 connected to outlet 22 and a second opening 48 in open fluid communication with interior storage volume 13.

Suction accumulator 10, in accordance with a preferred embodiment of the present invention, includes a vessel interior partition assembly 50, comprising interfitting dirt trap baffle member 52 and transition cap member 54. Partition assembly 50 substantially separates interior storage volume 13 into an upper active zone 56 and a lower quiet zone 58. As shown in FIG. 1, and more fully described hereinafter, baffle member 52 is retained at a peripheral edge thereof between tubular casing 14 and bottom end wall 12, and is axially supported at a central portion thereof against depressed portion 36 of vessel 12. Transition cap member 54 is sealingly secured to a lower end portion of conduit 38 to provide fluid communication between downflow passage 42 and upflow passage 44 of conduit 38. Additionally, transition cap member 54 includes a bleed-through orifice 60 through which liquid refrigerant from quiet zone 58 is metered into gaseous refrigerant flowing through upflow passage 44. Transition cap member 54 may be sealed to conduit 38 by an interference fit, plastic welding, an adhesive, or the like, depending on the materials chosen for cap member 54 and conduit 38.

Figure 2:
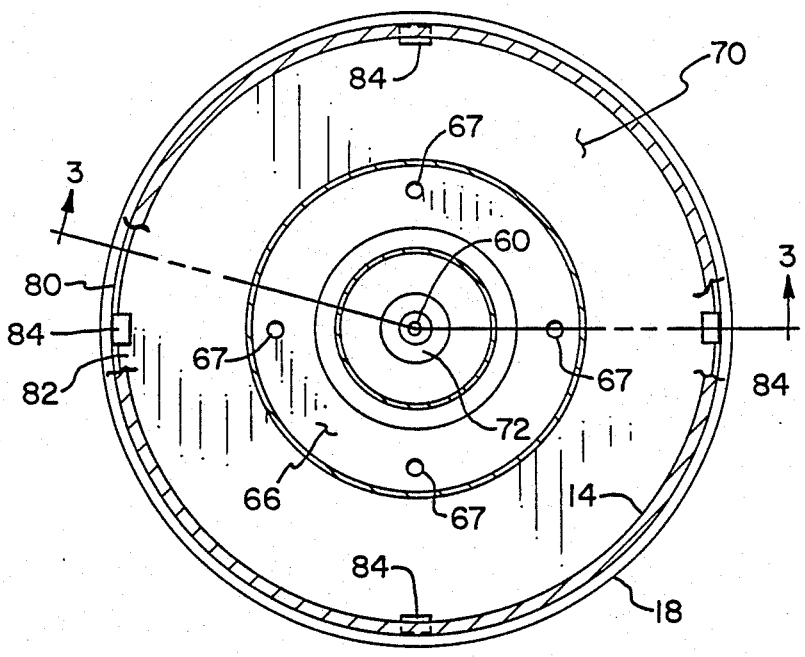
FIG. 2 is a fragmentary transverse sectional view of the suction accumulator of FIG. 1, taken along the line 2—2 in FIG. 1 and viewed in the direction of the arrows, particularly showing the orifice in the transition cap and four radially spaced holes and spacer tabs in the dirt trap baffle.

Dirt trap baffle member 52 and transition cap member 54 will now be more particularly described with reference to FIGS. 2 and 3. In the preferred embodiment, both baffle member 52 and cap member 54 are manufactured as stamped sheet metal parts. Baffle member 52 comprises a round plate member having a radially serpentine configuration. More specifically, baffle member 52 includes a round central bottom wall 62, a cylindrical barrier wall 64 extending upwardly from bottom wall 62, an annular top wall 66 extending radially outwardly from the top edge of barrier wall 64, a radially outer cylindrical wall 68 extending downwardly from the outer edge of top wall 66, and a frustoconical flange member 70 extending radially outwardly from the bottom edge of cylindrical wall 68. Furthermore, top wall 66 is provided with a plurality of circumferentially spaced holes 67, the purpose of which will be described hereinafter.

Transition cap member 54 also has a radially serpentine configuration, whereby a radially innermost protrusion 72 essentially forms a conduit extending upwardly into upflow passage 44, whereat bleed-through orifice 60 provides a liquid inlet opening for liquid refrigerant to enter the gaseous refrigerant flow within conduit 38. Cap member 54 also includes a radially inner cylindrical wall portion 74 and a radially outer cylindrical wall portion 76. Cap member 54 is assembled on top of baffle member 52 such that respective outer walls 76 and 68 sealingly interfit, as by a friction fit therebetween. Outer wall 76 rests against flange member 70 to provide positive axial support of cap member 54 on baffle member 52. As is apparent from FIG. 3, a radially inner portion of cap member 54 extends downwardly, in spaced relationship, into a well defined by bottom wall 62 and cylindrical barrier wall 64 of baffle member 52. A filter screen 78 is placed over the downwardly extending portion of cap member 54 to filter fine particles of foreign material in the liquid refrigerant entering protrusion 72.

In accordance with the preferred embodiment of the present invention, fluid communication between active zone 56 and quiet zone 58 is provided through an annular gap 80 defined between a peripheral edge portion 82 of baffle member 52 and the interior of vessel 12. More specifically, a plurality of circumferentially spaced axial spacer tabs 84 are provided on the periphery of baffle member 52, and are retained between tubular casing 14 and bottom end wall 18. In this arrangement, peripheral edge portion 82, constituting the peripheral edge of baffle member 52 circumferentially intermediate tabs 84, is spaced from both casing 14 and end wall 18. According to the preferred embodiment, spacer tabs 84 are formed by initially stamping baffle member 52 with radially extending portions and then folding them radially inwardly to form a tab having a greater thickness then the adjacent peripheral edge portion.

In operation, refrigerant fluid, including gaseous and entrained liquid refrigerant, flows through inlet 20 and is separated by baffle 28 into its gaseous and liquid components. Because of the influence of baffle 28, the liquid component will flow to the bottom of the storage vessel 12 in a downwardly spiralling path along the inside wall of casing 14. Accordingly, any foreign particles in the liquid refrigerant, such as dirt or the like, will tend toward the periphery of the vessel for attempted passage through gap 80. The gaseous component will flow, as indicated by arrows 86, from the upper end of storage vessel 12, through downflow passage 86, a connecting passage defined by cap member 54, and upflow passage 44, and out through outlet 22. Metering of liquid refrigerant through orifice 60 is in accordance with Bernoulli's principle, whereby a lower pressure is present at the location of orifice 60 than exists in the liquid refrigerant at the bottom of vessel 12. As the liquid refrigerant enters upflow passage 44, it will be aspirated into a mist which blends with the gaseous component traveling through upflow passage 44 and into the suction side of a compressor.

Referring once again to FIG. 3, quiet zone 58 is separated into a radially outer region 88 defined by baffle member 52 and bottom end wall 18, and a radially inner region 90 defined by baffle member 52 and transition cap member 54. Cylindrical barrier wall 64 forms an upwardly extending wall over which liquid refrigerant flows, i.e., through holes 67, in a tortuous flow path from outer region 88 to inner region 90. Liquid refrigerant within inner region 90 passes through filter screen 78 and upwardly into protrusion 72.

In accordance with the previously described preferred embodiment of the present invention, a multistage dirt trapping and filtering system is provided, wherein foreign particles in the refrigerant are isolated in suction accumulator 10 and prevented from reentering the refrigeration system associated therewith. Specifically, annular gap 80 is sized so as to prevent the larger particles from passing from active zone 56 into quiet zone 58. for instance, annular gap 80 may be sized so as to isolate particles in active zone 56 having diameters of 0.025 inches or larger. As previously described, liquid refrigerant entering radially outer region 88 through gap 80 flows along a tortuous flow path over barrier wall 64, in the process depositing and isolating foreign particles at the bottom of outer region 88. Foreign particles still present in the refrigerant within inner region 90 are deposited and isolated at the bottom thereof as the refrigerant flow upwardly through filter screen 78. In the preferred embodiment, screen 78 is an $80 \times 70 \times 0.0055$ inch mesh, which is believed to be sufficiently small to filter out any remaining foreign particles potentially damaging to the refrigeration system. Accordingly, progressive filtering and isolation of foreign particles occurs as the liquid refrigerant flows form the interior of vessel 12 into conduit 38, namely, at annular gap 80, in radially outer region 88, in radially inner region 90, and against filter screen 78.

Suction accumulator 10, as described herein, is particularly suited for accomplishing the method of the present invention wherein foreign particles within the refrigerant fluid of a refrigeration system are isolated. specifically, the refrigerant fluid is directed through inlet 20 and separated into a liquid component and a gaseous component. A flow path, comprising conduit 38, is provided for the gaseous component to outlet 22. Partition assembly 50 is provided to define upper active zone 56 and lower quiet zone 58, whereby the liquid component flows from active zone 56 to radially outer region 88 of quiet zone 58 through annular gap 80. Foreign particles are isolated in outer region 88 as liquid refrigerant flow along a tortuous flow path over barrier wall 64 into radially inner region 90. Further foreign particles are isolated within inner region 90 before the liquid refrigerant flows into upflow passage 44 through orifice 60.

It will be appreciated from the foregoing, that radially outer region 88 and radially inner region 90 of quiet zone 58 provide storage areas for isolating and storing foreign particles potentially harmful to a refrigeration system. Because these areas are protected from the turbulent environment normally present within an accumulator, the foreign particles are substantially prevented from being stirred up and reentering the refrigeration system.

It will be appreciated that the foregoing is presented by way of illustration only, and not by way of any limitation, and that various alternatives and modifications may be made to the illustrated embodiment without departing from the spirit and scope of the invention.

What is claimed is:

1. A suction accumulator for a compressor of a refrigeration system, comprising:

a vertical storage vessel defining an interior storage volume, said vessel having a top end and a bottom end and including a vessel inlet and a vessel outlet located at said top end thereof, said vessel being adapted for storing gaseous and liquid refrigerant introduced through said vessel inlet for drawing out through said vessel outlet;

a conduit, disposed within said vessel, having an end opening connected to said vessel outlet, a gas inlet opening means located toward said vessel top end for communication with the gaseous refrigerant, and a liquid inlet opening means located in a radially inner region of said interior storage volume toward said vessel bottom end for communication with the liquid refrigerant;

baffle means disposed within said vessel, for directing the liquid refrigerant within said vessel to a radially outer region of said interior storage volume toward said vessel bottom end; and upwardly extending barrier means, disposed between said radially outer region and said radially inner region, for causing tortuous flow of the liquid refrigerant from said radially outer region to said radially inner region.

2. The suction accumulator of claim 1 in which:

said baffle means comprises radially extending partition means for substantially separating said storage volume into an upper active zone and a lower quiet zone, and fluid passage means for providing fluid communication between said active zone and said quiet zone, said radially outer region being within said quiet zone.

3. The suction accumulator of claim 2 in which:

said storage vessel comprises a generally cylindrical central portion and a lower end cap, and said partition means comprises a partition plate member of which a peripheral portion is retained intermediate said central portion and said end cap.

4. The suction accumulator of claim 2 in which:

said storage vessel comprises a generally cylindrical central portion and a lower end cap; and said partition means comprises a partition plate member having along an outer peripheral edge thereof a plurality of circumferentially spaced spacer tabs, said tabs being retained intermediate said central portion and said end cap, portions of said plate member outer peripheral edge intermediate said tabs being spaced from said storage vessel to define a substantially annular gap through which liquid refrigerant flows from said active zone to said radially outer region within said quiet zone.

5. The suction accumulator of claim 1 in which:

said barrier means comprises an annular wall over which the liquid refrigerant flows from said radially outer region to said radially inner region.

6. The suction accumulator of claim 5 in which:

said baffle means comprises a partition plate member having a vertically extending wall portion forming said annular wall.

7. The suction accumulator of claim 1 in which:

said baffle means comprises a radially extending partition plate member substantially separating said storage volume into an upper active zone and a lower quiet zone; and said liquid inlet means comprises a transition cap member secured to said conduit and having a bleed-through orifice therethrough, said transition cap member extending between said conduit and said plate member, said radially outer region being defined by said plate member and said storage vessel, and said radially inner region being defined by said plate member and said transition cap member.

8. The suction accumulator of claim 7 in which:

said plate member includes passage means extending therethrough for providing fluid communication between said radially outer region and said radially inner region such that fluid flow therebetween is along a tortuous flow path.

9. A suction accumulator for a compressor of a refrigeration system, comprising:

a vertical storage vessel defining an interior storage volume, said vessel having a top end and a bottom end and including a vessel inlet and a vessel outlet located at said top end thereof, said vessel being adapted for storing gaseous and liquid refrigerant introduced through said vessel inlet for drawing out through said vessel outlet;

a conduit, disposed within said vessel, having an end opening connected to said vessel outlet, a gas inlet opening means located toward said vessel top end for communication with the gaseous refrigerant, and a liquid inlet opening means located toward said vessel bottom end for communication with the liquid refrigerant;

partition means located near said bottom end for substantially separating said storage volume into a lower quiet zone and an upper active zone, said gas inlet opening means being in fluid communication with said active zone and said liquid inlet opening means being in fluid communication with said quiet zone; and passage means for providing fluid communication between said active zone and said quiet zone at a location radially outwardly from said liquid inlet opening means and adjacent the sidewall of said storage vessel.

10. The suction accumulator of claim 9 in which:

said storage vessel comprises a generally cylindrical central portion and a lower end cap, and said partition means comprises a partition plate member of which a peripheral portion is retained intermediate said central portion and said end cap.

11. The suction accumulator of claim 9 in which:

said storage vessel comprises a generally cylindrical central portion and a lower end cap; and said partition means comprises a partition plate member having plurality of circumferentially spaced spacer tabs along the periphery thereof, said tabs being retained intermediate said central portion and said end cap, a peripheral edge of said plate member intermediate said tabs being spaced from said storage vessel to define a substantially annular gap constituting said passage means through which liquid refrigerant flows from said active zone to a radially outer region within said quiet zone.

12. The suction accumulator of claim 9 wherein said lower quiet zone comprises a radially outer region and a radially inner region, and further comprising:

an annular wall, disposed between said radially outer region and said radially inner region, over which the liquid refrigerant flows in a tortuous flow path from said radially outer region to said radially inner region.

13. The suction accumulator of claim 12 in which:

said partition means comprises a partition plate member having a vertically extending wall portion forming said annular wall.

14. A suction accumulator for a compressor of a refrigeration system having refrigerant fluid in which foreign particles may become suspended, comprising:

a vertical storage vessel defining an interior storage volume, said vessel having a top end and a bottom end and including a vessel inlet and a vessel outlet located at said top end thereof, said vessel being adapted for storing gaseous and liquid refrigerant introduced through said vessel inlet for drawing out through said vessel outlet;

a conduit, disposed within said vessel, having an end opening connected to said vessel outlet, a gas inlet opening means located toward said vessel top end for communication with the gaseous refrigerant, and a liquid inlet opening means located toward said vessel bottom end for communication with the liquid refrigerant; and multi-stage trap means located toward said vessel bottom end for trapping and isolating said foreign particles suspended in the liquid refrigerant as the refrigerant flows within said interior storage volume toward said liquid inlet opening means;

said trap means comprising: a first trap chamber in fluid communication with said vessel interior at a radially outer region of said interior storage volume adjacent the sidewall of said vessel; a second trap chamber in fluid communication with said liquid inlet opening means at a radially inner region of said interior storage volume; and passage means between said first and second trap chambers for forming a tortuous flow path for liquid refrigerant flowing from said first trap chamber to said second trap chamber.

15. The suction accumulator of claim 14, and further comprising:

partition means for substantially separating said storage volume into a lower quiet zone and an upper active zone, said trap means being within said quiet zone.

16. The suction accumulator of claim 15 in which:

said storage vessel comprises a generally cylindrical central portion and a lower end cap; and said partition means comprises a partition plate member having a plurality of circumferentially spaced spacer tabs along the outer periphery thereof, said tabs being retained intermediate said central portion and said end cap, a peripheral edge of said plate member intermediate said tabs being spaced from said storage vessel to define a substantially annular gap, whereby said first trap chamber is in fluid communication with said active zone through said substantially annular gap.

17. The suction accumulator of claim 16 in which:

said peripheral edge of said plate member is spaced from said storage vessel such that said resulting gap is capable of trapping the largest of the foreign particles.

18. The suction accumulator of claim 14 in which:

said passage means between said first and second trap chambers comprises an annular wall, disposed between said radially outer region and said radially inner region, over which the liquid refrigerant flows in a tortuous flow path from said radially outer location to said radially inner location.

19. A suction accumulator, comprising:

a storage vessel including a casing having a first end wall and defining a fluid storage volume;

an inlet and an outlet for said vessel;

a first conduit disposed in said vessel, said conduit having first and second ends, said conduit including a divider means for forming first and second fluid passageways therein, said first fluid passageway being open to said fluid storage volume and said second fluid passageway being connected to said outlet both at said conduit first end;

partition means within said vessel, including a transition member secured to said conduit second end, for substantially separating said fluid storage volume into a lower quiet zone and an upper active zone, said transition member forming a third fluid passageway interconnecting said first fluid passageway and said second fluid passageway; and a second conduit extending from said lower quiet zone into said second fluid passageway.

20. The suction accumulator of claim 19 in which:

said partition means comprises a partition plate member having a top surface and a bottom surface, said transition member contacting said plate member top surface, said plate member and said storage vessel defining a radially outer region of said quiet zone and said plate member and said transition member defining a radially inner region of said quiet zone.

21. The suction accumulator of claim 20 in which:

said partition plate member includes fluid passage means extending therethrough for providing fluid communication between said radially outer region and said radially inner region such that the fluid flow therebetween is along a tortuous flow path.

22. The suction accumulator of claim 20 in which:

said second conduit extends from said radially inner region into said second fluid passageway.

23. A method for separating and isolating foreign particles from refrigerant fluid in a suction accumulator, wherein said accumulator includes a vertical storage vessel defining an interior storage volume and having a top end and a bottom end, said vessel having an inlet and an outlet located at said top end, said method comprising:

directing refrigerant fluid through said inlet into said interior storage volume;

separating the refrigerant fluid into a liquid component and a gaseous component;

providing a flow path for said gaseous component to said outlet;

directing said liquid component to flow to a radially outer region of said storage volume at said bottom end; and trapping said foreign particles in said radially outer region as said liquid component is caused to flow radially inwardly along a tortuous flow path from said radially outer region to said flow path for said gaseous component.

24. The method of claim 23 wherein said liquid component flows along a tortuous flow path from said radially outer region to a radially inner region, and further comprising the step of:

trapping foreign particles in said radially inner region as said liquid component is caused to flow therefrom to said flow path for said gaseous component.

25. The method of claim 23 wherein said step of directing said liquid component to flow to said radially outer region includes trapping foreign particles prior to their entering said radially outer region.

26. A method for separating and isolating foreign particles from refrigerant fluid in a suction accumulator, wherein said accumulator includes a vertical storage vessel defining an interior storage volume and having a top end and a bottom end, said vessel having an inlet and an outlet located at said top end, said method comprising:

directing refrigerant fluid through said inlet into said interior storage volume;

separating the refrigerant fluid into a liquid component and a gaseous component;

providing a flow path for said gaseous component to said outlet;

providing a partition within said vessel to define an upper active zone thereabove and a lower quiet zone therebelow adjacent said vessel bottom;

isolating foreign particles within said radially outer region;

directing said liquid component within said radially outer region to flow along a tortuous flow path from said radially outer region to a radially inner region of said quiet zone;

isolating foreign particles within said radially inner region; and providing a flow path for said liquid component at said radially inner region to said flow path for said gaseous component.

27. The method of claim 26 and further comprising the step of isolating foreign particles within said active zone.

28. The method of claim 27 in which:

progressively smaller foreign particles are isolated in said active zone, said radially outer region, and said radially inner region.

29. The method of claim 26 and further comprising the step of:

filtering said liquid component flowing from said radially inner region to said flow path for said gaseous component.

30. The method of claim 26 wherein said storage vessel is generally cylindrical and said accumulator includes an entrance baffle disposed within said storage vessel, and further comprising the step of:

deflecting said refrigerant fluid directed through said inlet, by means of said entrance baffle, to flow in a substantially spiralling flow path along the interior sidewall of said storage vessel downwardly toward said vessel bottom.

* * * * *